US005746583A

United States Patent [19]

Spear

[11] Patent Number: 5,746,583

[45] Date of Patent: May 5, 1998

[54] VACUUM BOOST DEVICE

[76] Inventor: Scott Spear, P.O. Box 295233, Lewisville, Tex. 75029-5233

[21] Appl. No.: 610,071

[22] Filed: Feb. 29, 1996

Related U.S. Application Data

[63] Continuation of Ser. No. 375,307, Jan. 20, 1995, abandoned.

[51] Int. Cl.[6] ..... F04F 5/16; F04F 5/44

[52] U.S. Cl. ..... 417/197; 417/179; 417/151; 239/543; 239/548

[58] Field of Search ..... 417/179, 197, 417/198, 151, 87, 169, 172; 239/543, 548

[56] References Cited

U.S. PATENT DOCUMENTS

| | | | |
|---|---|---|---|
| 640,463 | 1/1900 | Gildea | 417/172 |
| 792,081 | 6/1905 | Shepard | 417/179 |
| 2,639,084 | 5/1953 | MacKenzie | 417/197 |
| 2,673,125 | 3/1954 | Squire, Jr. | 417/179 |
| 2,786,651 | 3/1957 | Mickle | 417/179 |
| 3,175,515 | 3/1965 | Cheely | 417/197 |
| 3,457,863 | 7/1969 | Carter | 417/179 |
| 4,149,453 | 4/1979 | Reed | 417/179 |
| 4,288,288 | 9/1981 | Fleck et al. | 239/548 |
| 4,322,897 | 4/1982 | Brassfield | 417/179 |
| 4,400,138 | 8/1983 | Baer | 417/179 |
| 4,407,450 | 10/1983 | Chegolya et al. | 239/543 |
| 4,815,942 | 3/1989 | Alperin et al. | 417/179 |
| 4,842,777 | 6/1989 | Lamort | 417/179 |
| 4,924,898 | 5/1990 | Eveson | 417/244 |

FOREIGN PATENT DOCUMENTS

| | | | |
|---|---|---|---|
| 453941 | 3/1947 | Canada | 239/543 |
| 7810010 | 4/1980 | Netherlands | 417/197 |
| 260399 | 7/1949 | Switzerland | 417/197 |
| 971563 | 9/1964 | United Kingdom | 417/179 |

*Primary Examiner*—Timothy S. Thorpe
*Assistant Examiner*—Ted Kim
*Attorney, Agent, or Firm*—John E. Vandigriff

[57] ABSTRACT

A vacuum boost device is connected in line with a vacuum suction line. The boost device includes a housing connected in said vacuum line and an inlet through which air of a liquid is directed to enter into the vacuum stream to assist in the vacuum and to break debris drawn through the boost device into smaller particles.

6 Claims, 8 Drawing Sheets

| Specific Gravity | 0.7 | 0.8 | 0.9 | 1.0 | 1.1 | 1.2 | 1.3 |
|---|---|---|---|---|---|---|---|
| | | | | | | | |
| Pressure | Height | Height | Height | Height | Height | Height | Height |
| 0.00 | 21.00 | 21.00 | 21.00 | 21.00 | 21.00 | 21.00 | 21.00 |
| 5.00 | 37.07 | 35.06 | 33.50 | 32.25 | 31.23 | 30.38 | 29.65 |
| 10.00 | 53.14 | 49.13 | 46.00 | 43.50 | 41.45 | 39.75 | 38.31 |
| 15.00 | 69.21 | 63.19 | 58.50 | 54.75 | 51.68 | 49.13 | 46.96 |
| 20.00 | 85.29 | 77.25 | 71.00 | 66.00 | 61.91 | 58.50 | 55.62 |
| 25.00 | 101.36 | 91.31 | 83.50 | 77.25 | 72.14 | 67.88 | 64.27 |
| 30.00 | 117.43 | 105.38 | 96.00 | 88.50 | 82.36 | 77.25 | 72.92 |
| 35.00 | 133.50 | 119.44 | 108.50 | 99.75 | 92.59 | 86.63 | 81.58 |
| 40.00 | 149.57 | 133.50 | 121.00 | 111.00 | 102.82 | 96.00 | 90.23 |
| 45.00 | 165.64 | 147.56 | 133.50 | 122.25 | 113.05 | 105.38 | 98.88 |
| 50.00 | 181.71 | 161.63 | 146.00 | 133.50 | 123.27 | 114.75 | 107.54 |
| 55.00 | 197.79 | 175.69 | 158.50 | 144.75 | 133.50 | 124.13 | 116.19 |
| 60.00 | 213.86 | 189.75 | 171.00 | 156.00 | 143.73 | 133.50 | 124.85 |
| 65.00 | 229.93 | 203.81 | 183.50 | 167.25 | 153.95 | 142.88 | 133.50 |
| 70.00 | 246.00 | 217.88 | 196.00 | 178.50 | 164.18 | 152.25 | 142.15 |
| 75.00 | 262.07 | 231.94 | 208.50 | 189.75 | 174.41 | 161.63 | 150.81 |
| 80.00 | 278.14 | 246.00 | 221.00 | 201.00 | 184.64 | 171.00 | 159.46 |
| 85.00 | 294.21 | 260.06 | 233.50 | 212.25 | 194.86 | 180.38 | 168.12 |
| 90.00 | 310.29 | 274.13 | 246.00 | 223.50 | 205.09 | 189.75 | 176.77 |
| 95.00 | 326.36 | 288.19 | 258.50 | 234.75 | 215.32 | 199.13 | 185.42 |
| 100.00 | 342.43 | 302.25 | 271.00 | 246.00 | 225.55 | 298.50 | 194.08 |

FIGURE 8

VACUUM BOOST DEVICE

This application is a Continuation of application Ser. No. 08/375,307, filed Jan. 20, 1995, now abandoned.

FIELD OF THE INVENTION

This invention relates to vacuum pump systems, and more particularly to a power boost device that increases the vertical lifting height for which an existing vacuum pump system can lift debris or fluids.

BACKGROUND OF THE INVENTION

Vacuum pump systems for lifting and moving liquids and debris have a limitation on the height that material can be lifted. Vacuum pump systems used for removing collected debris and liquid sludge from pits, tanks, vats and other containers, sometimes require that the material be lifted in excess of 21 feet. Existing vacuum pump systems have a vertical lifting limitation of about 21 feet.

Prior art methods have used jet pumps at the source of the debris to pump the material, but this requires the pump and associated power to be placed inside, for example, the pit or tank, in order for the material to be removed. This requires careful handling where electrical power is involved, or access to the pit, tank, or vat may be so restrictive that the placement of a pump at the material would be impossible. There are no systems that exist or co-exist with a vacuum pump system.

Vacuum pump systems, including rotary vane pumps, remove air from a tank or container as in integrated unit. When the vacuum pump rotates, it removes the air from the container creating a vacuum inside the container. Rotary van pumps are rated by CFM (Cubic Feet per Minute). The larger the pump body, vane size and RPM, the greater the CFM rating. After the air has been removed from the tank or container, a valve at the end of a tank or container opposite the pump is opened, and a vacuum hose connected to the valve is placed in material that is to be pumped. The material is deposited in the tank or container and does not enter the pump. Since vacuum pumps can only produce a vacuum of 26 to 28 inches of mercury (in/hg), a vacuum system can only lift vertically approximate one foot per inch of vacuum (in/hg).

SUMMARY OF THE INVENTION

The invention is a power boost device that is connected in a vacuum line between the vacuum source and the material to be picked up by the vacuum. The boost device has an inlet for drawing or injecting air, gases, or a fluid which flows through a plurality of jets to a central point inside the boost device. The air, gas, or fluid injected into the boost device helps break up the material being picked-up into smaller particles when the material is a fluid or sludge. The movement of the air or liquid into the boost device and vacuum lines also increases the lifting capability of the existing vacuum pump system.

The technical advance represented by the invention, as well as the objects thereof, will become apparent from the following description of a preferred embodiment of the invention when considered in conjunction with the accompanying drawings, and the novel features set forth in the appended claims.

BRIEF DESCRIPTION OF THE DRAWINGS

FIG. 8 is a table showing the lift height vs injected pressure for materials of different specific gravity.

DESCRIPTION OF A PREFERRED EMBODIMENT

Figure 1:
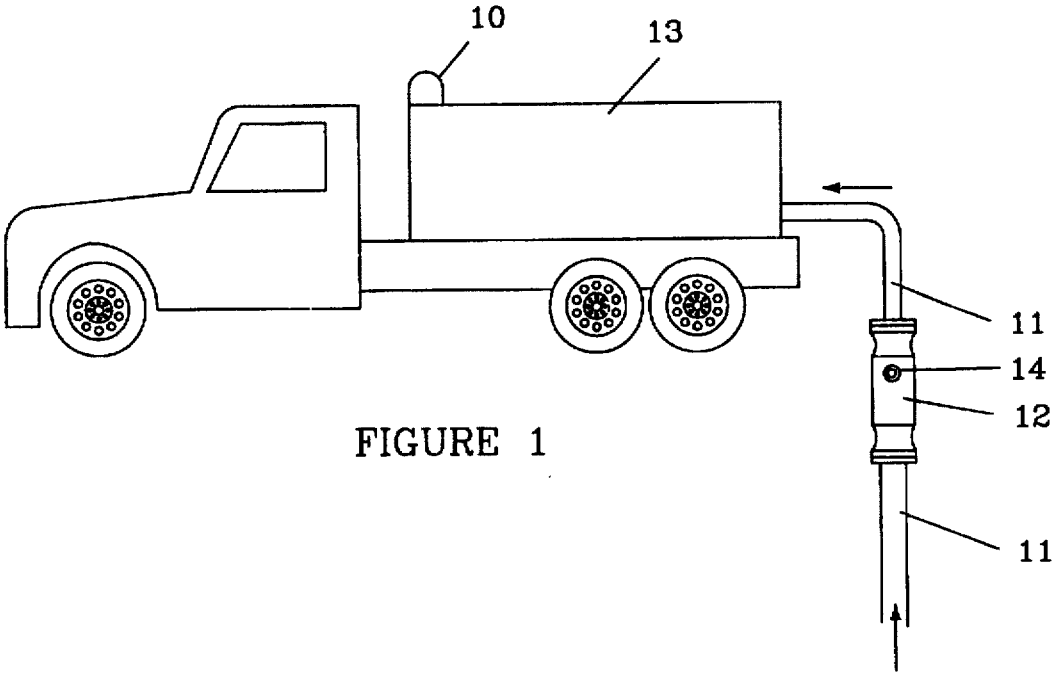
FIG. 1 shows a vacuum pump system connected to a tanker truck with the boost device of the present invention connected in the vacuum line.

FIG. 1 shows a vacuum pump system 10 mounted on a vacuum tanker truck 13 with the boost device 12 connected in a vacuum line 11. Vacuum line 11 is placed in a well, sump hole, or other source of sand, sludge or dry particulate debris that is to be removed. When the vertical distance between the vacuum tanker truck 13 and material to be removed is greater than the vacuum system will lift, then boost device 12 is placed in the vacuum line 11. Air or gas may be drawn into or air, gas or liquid may be injected into boost device 12 at inlet 14.

Figure 2:
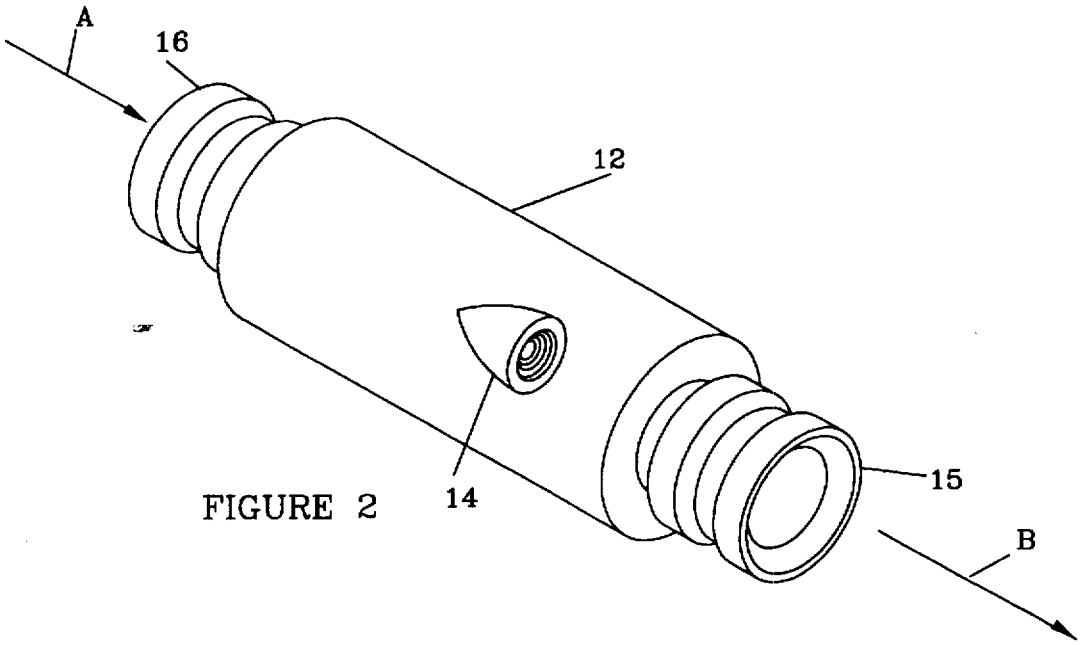
FIG. 2 shows the boost device of the present invention.

FIG. 2 illustrates boost device 12, showing the direction of vacuum pull, as indicated by arrows A and B. End 16 is placed at the material to be pumped or, connected to the vacuum line from which material is to pick-up, and end 15 is connected to the line toward the vacuum system. The direction is determined by inlet 14. Inlet 14 is connected internal of boost device 12 to a plurality of outlets which direct the air or liquid into the vacuum stream.

Figure 4:
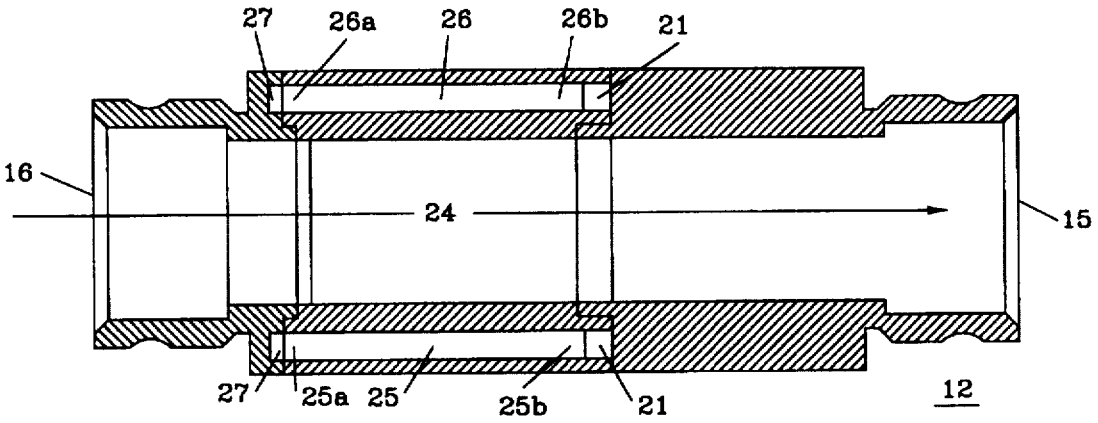
FIG. 4 is a cross-section view of the boost device of FIG. 3 rotated 45 degrees.
Figure 3:
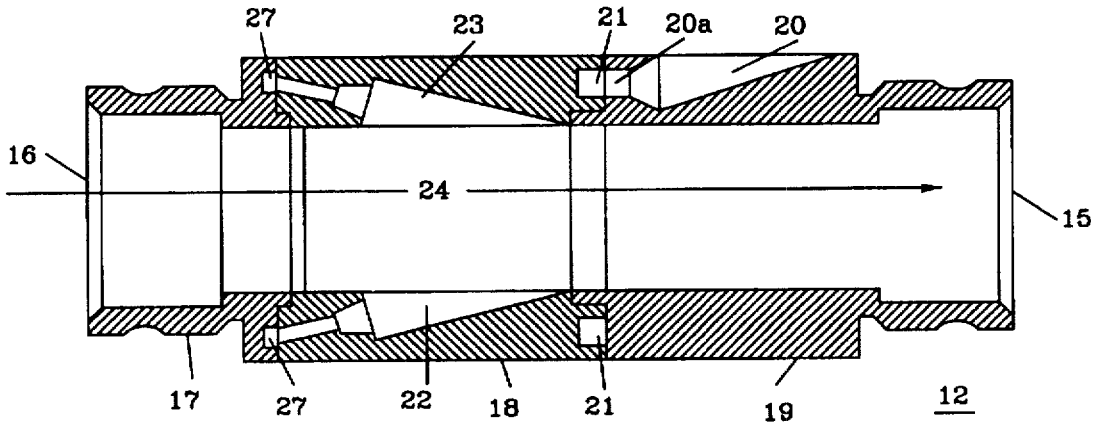
FIG. 3 is a cross-section view of the boost device of FIG. 2.

FIG. 3 and 4 are cross-sectional views of boost device 12. FIG. 4 is rotated forty-five degrees from FIG. 3. Vacuum boost device 12 is made up of three principal parts, parts 17, 18 and 19. Part 17 includes end 16 that is attached to the suction hose at the end used to pick up debris, or left open and placed directly at or in the material to be pumped. In part 17 is a circular channel 27 that extends around part 17 and joins four linear channels in part 18. Two of the linear channels, 25 and 26 are shown in FIG. 4. The four linear channels are spaced at 90 degree intervals around part 18. End 26*a* of channel 26 is connected to circular channel 27. The opposite end 26*b* of channel 26 is connected to circular channel 21 that extends around part 18.

Internal to part 18 are four outlets. Two of the four outlets, outlets 22 and 23, are shown in FIG. 3. The four outlets are spaced at ninety degree angles around the internal channel 24 that extends through the boost device. Each of the four outlets are connected to circular channel 27.

Figure 5:
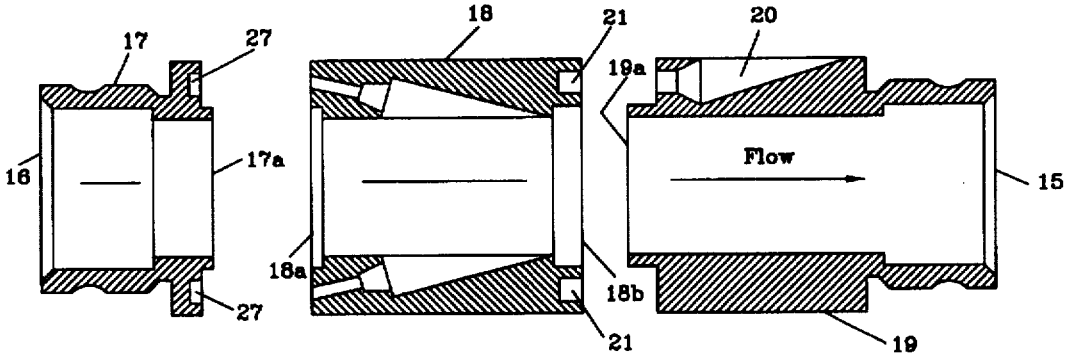
FIG. 5 shows the boost device exploded into three major parts.

FIG. 5 is an exploded view of device 12 showing the three parts 17, 18 and 19 separated. End part 17 has an end 17*a* that joins to end 18*a* of part 18. When the two parts 17 and 18 are jointed circular channel 27 is formed. Similarly, when end 18*b* of part 18 joins to end 19*a* of part 19, circular channel 21 is formed.

End 15 of part 19 connects to a vacuum line that connects to the vacuum source.

Figure 6B:
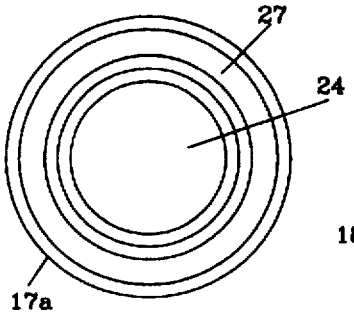
FIGS. 6*b*, 6*d* and 6*f* are end views of the parts in FIGS. 6*a*, 6*c* and 6*e*.

FIGS. 6*a*–6*f* illustrate the circular channels. FIG. 6*b* is an end view of part 17 showing end 17*a*. Circular channel 27 is shown in end 17*a*. Circular channel is closed when end 17*a* is joined to end 18*a* of part 18.

Figure 6D:
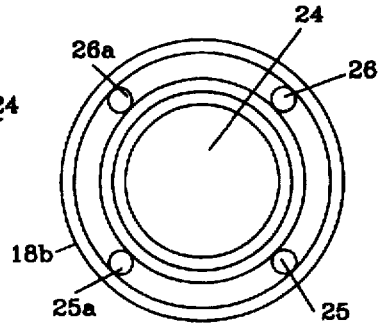
Figure 6F:
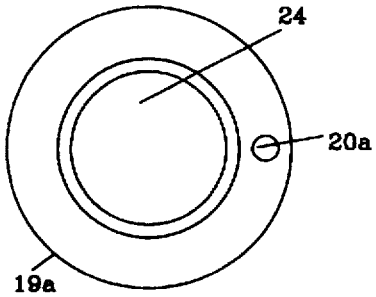
Figure 6A:
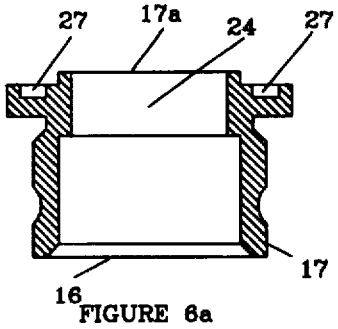
FIGS. 6*a*, 6*c*, and 6*e* are side views the same as in FIG. 5, but shown in vertical positions.
Figure 6C:
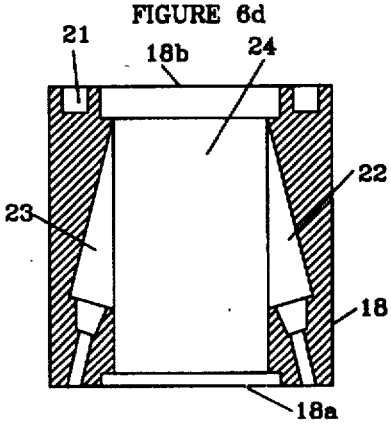
Figure 6E:
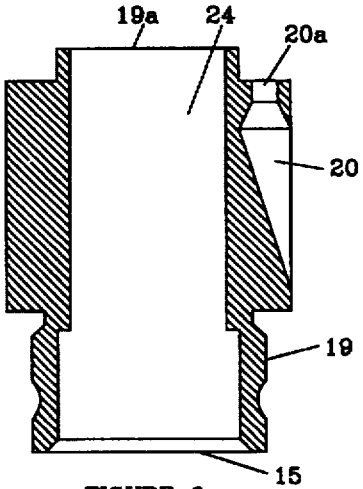

FIG. 6*d* is an end view of end 18*b* of part 18. Circular channel 21 is shown in end 18*b*. Channel 21 is closed when end 18*b* is joined to end 19*a* of part 19. There are four internal channels in part 18. These are channels 26, 26*a*, 25 and 25*a*. Each of these channels extends between circular channels 27 and 21. Air or fluid is injected into boost device 12 through inlet 20 which is joined to circular channel 21 through channel 20*a*.

Figure 7:
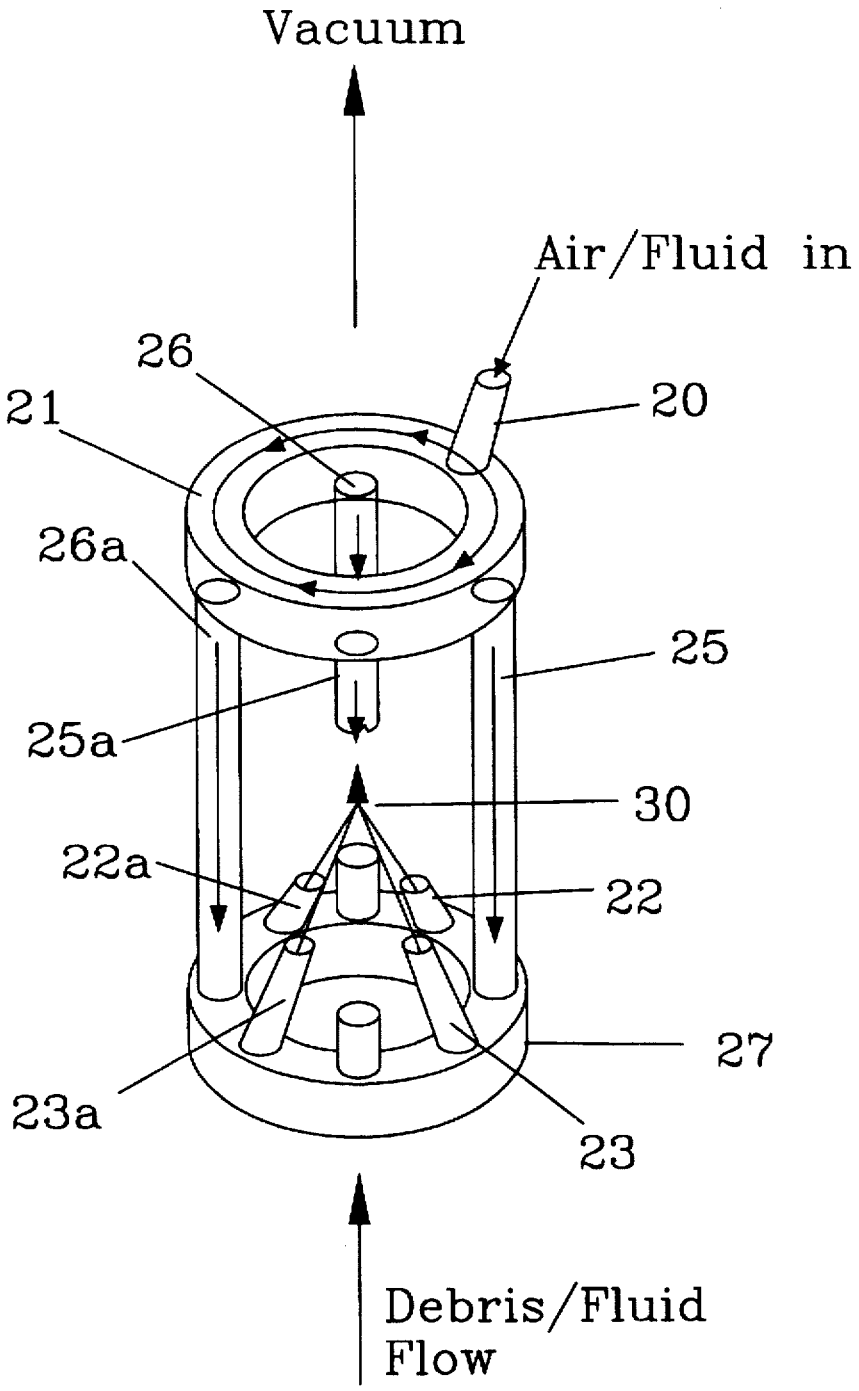
FIG. 7 illustrates the air or fluid flow within the boost device.

The air/fluid flow within the power booster is shown in FIG. 7. Air or liquid is injected into inlet 20. The injected air circulates in channel 21 and flows through channels 25, 25*a*, 26 and 26*a* to channel 27. The air circulates in channel 27 and exits through outlets 22, 22*a*, 23 and 23*a* which direct the air flow to a common point 30 on the central axis of the power booster. The Vacuum system is pulling the Debris/fluid upward though the booster and the directed air flow at 30 provides a boost or adds to the vacuum pull enabling the system to lift debris and fluid higher than would be possible without the vacuum booster.

The directed air/liquid stream at 30 breaks up sludge and other non-solid waste material into smaller particles making them lighter and easier to be lifted by the vacuum system.

FIG. 8 is a table of data showing the lifting height of the vacuum boost device for material of different specific gravity and for different pressures of air, gas or liquid injected into the vacuum boost device. For each specific gravity, the lifting height varies with the injection pressure.

Figure 9:
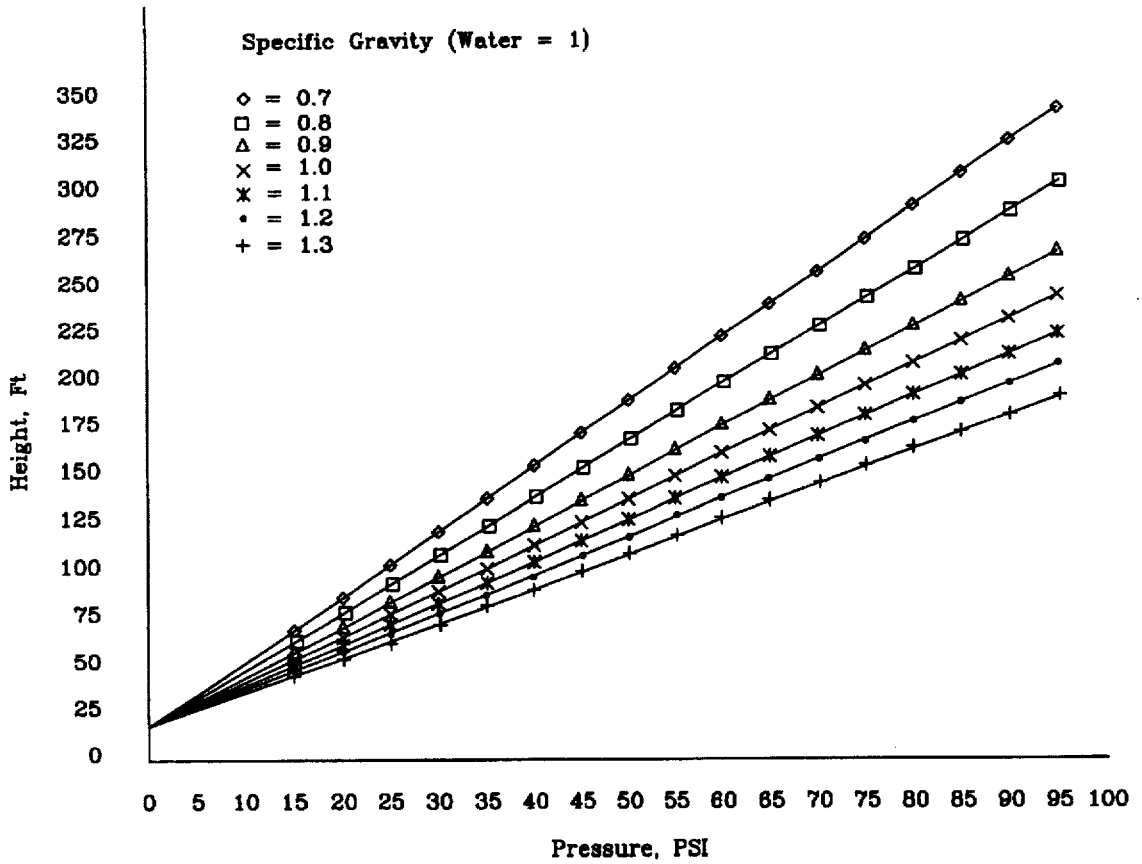
FIG. 9 is a plot of the data of FIG. 8

FIG. 9 is a plot of the data of FIG. 8 showing lift height for different pressures, and for materials of different specific gravities.

What is claimed:

1. A vacuum boost device used in conjunction with a vacuum truck system for moving material a vertical distance, comprising:

a housing, having first, second, and third housing parts sequentially connected, end to end, to each other, and having an internal channel through the housing through which a vacuum is drawn;

a first annular channel in said housing formed from a circular cavity in said first part of said housing, and enclosed by an end of said second part;

a second annular channel formed from a circular cavity in an end of said second cylindrical part and enclosed by an end of said third cylindrical part;

an inlet in said third part for injecting a fluid into said second annular channel;

a first plurality of linear channels connecting said first and second annular channels through the length of said second housing part; and a plurality of jet-outlets connected to said first annular channel directing the fluid introduced into said inlet into said internal channel.

2. A vacuum boost device used in conjunction with a vacuum truck system for moving material a vertical distance, comprising:

a housing having first, second and third sequentially joining cylindrical parts, said three parts each having an outer wall and coupling ends that join with one of another cylindrical part, and a vacuum line which forms a continuous internal channel through the housing, through which a vacuum is drawn;

a first annular channel in a coupling end of said first cylindrical part;

a second annular channel in a coupling end of said second cylindrical part;

a first plurality of linear channels in said second cylindrical housing part extending through the wall along the length of said second cylindrical part, connecting said first annular channel to said second annular channel;

an inlet in said third cylindrical part for injecting a fluid into said second annular channel;

a second plurality of channels extending between said first annular channel and said internal channel through the second cylindrical part; and a plurality of jet-outlets interconnected with said plurality of second channels for injecting said fluid into said internal channel.

3. The vacuum boost device according to claim 2, wherein said first housing part is attached to a suction line and said third housing part connects to a vacuum truck system.

4. The vacuum boost device according to claim 2, wherein there are four linear channels connected between said first and second annular channels.

5. The vacuum boost device according to claim 2, wherein there are four jet outlets connected to said first annular channel for directing a fluid from said inlet into said internal channel through said housing.

6. The vacuum boost device according to claim 2, wherein there are four jet outlets connected to said second annular channel for directing a fluid from said inlet into said internal channel through said housing.

* * * * *